US011465380B2

(12) United States Patent
Kuhn

(10) Patent No.: US 11,465,380 B2
(45) Date of Patent: Oct. 11, 2022

(54) FEED DEVICE, BALING PRESS, AND PROTECTION PROCESS

(71) Applicant: AUTEFA SOLUTIONS GERMANY GMBH, Friedberg (DE)

(72) Inventor: Rudolf Kuhn, Neusäß (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 540 days.

(21) Appl. No.: 16/327,035

(22) PCT Filed: Aug. 24, 2017

(86) PCT No.: PCT/EP2017/071371
§ 371 (c)(1),
(2) Date: Feb. 21, 2019

(87) PCT Pub. No.: WO2018/037090
PCT Pub. Date: Mar. 1, 2018

(65) Prior Publication Data

US 2019/0176427 A1 Jun. 13, 2019

(30) Foreign Application Priority Data

Aug. 26, 2016 (DE) ..... 20 2016 104 699.8

(51) Int. Cl.
*B30B 9/30* (2006.01)
*B30B 15/00* (2006.01)
*B30B 15/28* (2006.01)

(52) U.S. Cl.
CPC ..... *B30B 9/3078* (2013.01); *B30B 9/3003* (2013.01); *B30B 15/0082* (2013.01); *B30B 15/28* (2013.01)

(58) Field of Classification Search
CPC . B30B 9/3003; B30B 9/3078; B30B 15/0082; B30B 15/28; B30B 9/30; B30B 9/301; B30B 15/30
See application file for complete search history.

(56) References Cited

U.S. PATENT DOCUMENTS 4,108,063 A * 8/1978 Randolph ..... B30B 9/3003 100/215
2016/0007485 A1* 1/2016 Hartmann ..... H01L 23/047 361/752
2019/0184403 A1* 6/2019 Onesti ..... B02C 23/02

FOREIGN PATENT DOCUMENTS

| | | | |
|---|---|---|---|
| CA | 2 299 708 | A1 | 8/2001 |
| CN | 201151196 | Y | 11/2008 |
| CN | 201841683 | U | 5/2011 |
| CN | 103045461 | A | 4/2013 |
| CN | 203 854 228 | U | 10/2014 |
| CN | 204716986 | U | 10/2015 |
| CN | 105058849 | A | 11/2015 |
| DE | 296 09 493 | U1 | 10/1997 |
| DE | 102 46 188 | A1 | 5/2004 |

(Continued)

*Primary Examiner* — Jimmy T Nguyen
(74) *Attorney, Agent, or Firm* — McGlew and Tuttle, P.C.

(57) ABSTRACT

A feed device is for use on a baling press (1) and is for a loose fiber material (2) to be compressed. The feed device (4) has a movable and driven and possibly guided feed element (14, 15). The feed device (4) is assigned a protection device (3), which protects the drive area and possibly the guiding area of the feed device (4), in particular the bearing (19) thereof, against airborne fibers by using an opposing airstream (27).

13 Claims, 6 Drawing Sheets

(56) References Cited

FOREIGN PATENT DOCUMENTS

| | | | | | |
|---|---|---|---|---|---|
| DE | 10 2008 038543 | A1 | | 2/2010 | |
| EP | 1 120 237 | A2 | | 8/2001 | |
| WO | 97/45251 | A1 | | 12/1997 | |
| WO | WO-9745251 | A1 | * | 12/1997 | ..... B30B 9/301 |
| WO | 01/60521 | A1 | | 8/2001 | |

* cited by examiner 1
28
7
21
19
3
8
34
20
27
4,5
23
15
16
14
18
12,13
35
18
4,6
7,11
2
29
36

FEED DEVICE, BALING PRESS, AND PROTECTION PROCESS

CROSS REFERENCE TO RELATED APPLICATIONS

This application is a United States National Phase Application of International Application PCT/EP2017/071371 filed Aug. 24, 2017, and claims the benefit of priority under 35 U.S.C. § 119 of German Application 20 2016 104 699.8, filed Aug. 26, 2016, the entire contents of which are incorporated herein by reference.

TECHNICAL FIELD

The present invention pertains to a feed device, to a baling press equipped therewith for a loose fiber material to be pressed, wherein the feed device has a movable and driven as well as possibly guided feed element, and to a protection process for the feed device.

TECHNICAL BACKGROUND

Such a baling press and feed device are known from EP 1 120 237 A2. The feed device for the loose fiber material to be pressed also has a movable and driven as well as possibly guided feed element. The feed device is used, on the one hand, as a filling pusher of a filling device and, on the other hand, as a pressing device, especially as a prepress. The baling press is used to press fiber material, which consists of loose fibers, especially short cut fibers, so-called staple fibers. These lightweight fibers tend to contaminate the feed device and the pressed bales produced.

The problem of contamination occurs to an increased extent in U.S. Pat. No. 4,108,063 A. It discloses a baling press for dusty wastes with a feed device and with a perforated feed element as well as with an exhaust device arranged behind it. The document pertains to the removal of dust. Dust-laden air flows out of the material being pressed during pressing through the perforated feed element into a space behind the feed element and is suctioned from here by means of vacuum by an external blower and transported to a dust separator. The dust-laden air contaminates in said space the drive parts located there and the guide of the feed element.

SUMMARY

An object of the present invention is to show a bale-pressing technique with improved protection from contamination by the fibers.

The feed and bale-pressing technology being claimed, i.e., the feed device, the baling press equipped therewith and the bale-pressing process, as well as the protection technology employed for this offer reliable protection from airborne fibers (blown fuzz) in the area of the feed device and from contamination of the feed device and of the pressed bales produced by fibers.

The protection technology, i.e., the protection device and the protection process, prevent the entry of fibers to the drive area of the feed device by means of an opposing air stream. The opposing air stream is directed opposite the airborne fibers or the entry of fibers, which are to be prevented, and blows away the fibers. If the feed element of the feed device is additionally guided, the entry of fibers to the guide area of the feed device is also prevented with the protection technology. In particular, the penetration of fibers into the bearings of one or more components of the feed device can be prevented.

This prevents the adhesion of fibers in the drive area and possibly in the guide area of the feed device and a subsequent separation as well as entry of these fibers into the press area and into the pressed bale. As a result, contamination with the other fibers processed before is prevented in the baling press in case of a change from one type of fiber to another, e.g., when changing over from one color to another. On the other hand, caking and subsequent melting as well as destruction of fibers may also be prevented from occurring in the area of the feed device, especially in a bearing. In addition, such destroyed and contaminated fiber remnants can also be prevented hereby from entering the press area and the pressed bale again and from leading to contamination.

Within the framework of one aspect of the present invention, a feed element may be configured as a perforated plate with passage openings in the plate surface, through which openings air can pass. During a motion of the feed element, especially a linear motion, in a housing of the feed device, this makes possible an exchange of air as well as pressure equalization in the areas in front of and behind the perforated plate. This is favorable for preventing or at least extensively suppressing undesired airborne fibers. The perforated plate may be used especially successfully together with the protection technology being claimed. It is especially suitable for a pusher wall of a filling pusher.

The perforated plate may also advantageously be used in conventional and prior-art baling presses or feed devices without the protection technology being claimed, especially a feed device for use at a baling press and for a loose fiber material to be pressed, wherein the feed device has a movable and driven as well as possibly guided feed element or according to EP 1 120 237 A2.

The feed device may be present at the baling press as a single device or as a plurality of devices. It may also be used in different manners. It may be configured, for example, as a pressing device, especially a prepress, and/or as a filling pusher of a filling device. The feed element may correspondingly have different configurations, e.g., it may be configured as a pusher wall or as a press punch.

In various embodiments, the feed device has a housing each, in which the preferably plate-like feed element moves. This may be, e.g., a reversing linear motion in a direction of feed. As an alternative, it is a rotary or pivoting motion, e.g., in the manner of a bucket wheel, a pivoting slide or the like.

The feed device has a drive element and optionally a preferably separate guide element for the feed device. A drive element and a guide element are present especially in case of a linearly and reversibly moved feed element. A guide element may be eliminated, for example, in case of a rotatingly or pivotably moved feed element. The drive elements and optionally the guide elements may have various configurations; they may be configured, e.g., as a piston rod and as an extendable guide rod.

The protection device has an overpressure chamber with a chamber wall pointing towards the feed element. The overpressure chamber is preferably arranged behind the feed element in the direction of feed. It may be arranged within the housing of the feed device. The overpressure chamber may be sealed laterally and rearwardly.

One or more passage openings for a drive element and/or a guide element may be present in the chamber wall, and each passage opening is oversized to provide a free space, especially an annular space, for the passage of an opposing air stream from the overpressure chamber into the interior of the housing and to the feed element. The one or more passage openings make possible the passage of the drive and/or guide elements connected to the feed element during the feed motion and reversing motion of the feed element.

The chamber wall can seal the overpressure chamber with the exception of the free space or the free spaces against the interior of the housing and against the feed element. Access to the chamber from this direction is only possible via the free space or free spaces, with the opposing air stream counteracting.

This opposing air stream prevents the entry of fibers from the fiber material acted on by the feed element into the overpressure chamber. Further entry of such fibers to components of the feed device, e.g., a bearing of a drive element and/or guide element, which can be contaminated, is prevented hereby. Such a bearing may be located at a rear wall of the overpressure chamber and/or of the housing. The overpressure chamber forms a fiber-free or at least extensively fiber-free protection space for the drive and guide area of the feed device. The fibers remain on the front side or feed side of the feed element.

The protection technology being claimed may be used with special advantage for a filling device of the baling press. The filling device and the feed device have a housing with a closable inlet opening, which points towards a fiber feed device, and with an outlet opening directed towards the pressing area with a controllable closure. A precompaction device with a retaining device may be arranged in another advantageous embodiment for collecting and precompacting fiber material batch by batch in said housing. The retaining device secures the one or more precompacted fiber material batches located in the area of the outlet opening during the respective return stroke of the feed element, especially filling pusher, and facilitates the further filling and precompaction of the next batches of fiber material until the desired quantity of filling and the desired degree of precompaction of this quantity are reached.

The protection technology is particularly advantageous for such a filling and precompaction technique. In addition, configuration of the feed element as a perforated plate is also favorable. The pressure equalization through the perforated plate prevents vacuum on the rear side of the precompacted and retained area of fiber material and the suctioning back of fibers located there.

The present invention is schematically shown as examples in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
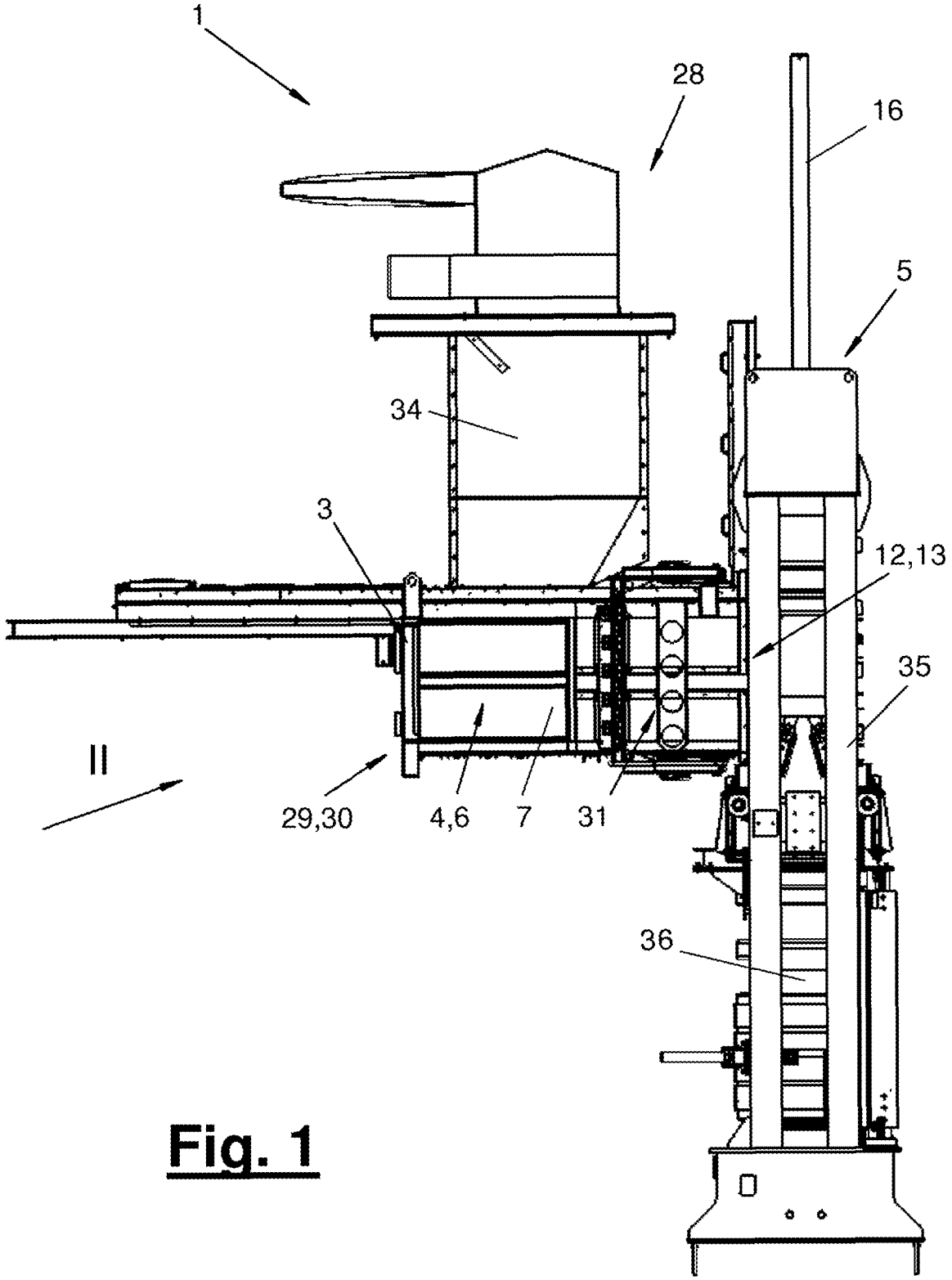
FIG. 1 is a side partially sectional view of baling press with a feed device for fiber material and with a protection device in a lateral view.
Figure 2:
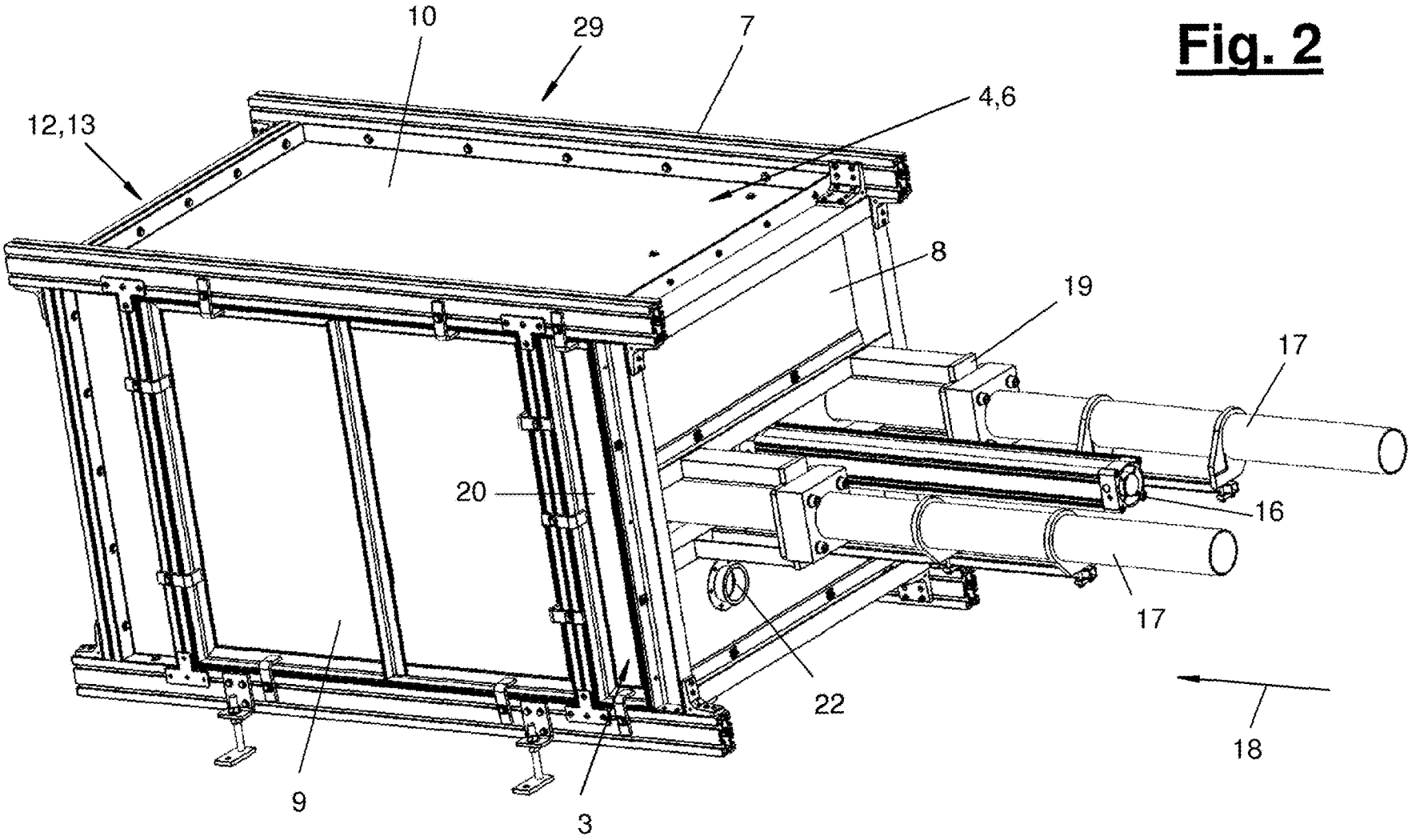
FIG. 2 is a perspective view of a feed device with a protection device at a filling device in a perspective view.

Referring to the drawings, the present invention pertains to a baling press (1) with a feed device (4) and with an associated protection device (3). The present invention further pertains to a bale-pressing process with a feed process and with a protection process. In addition, the present invention pertains to a feed device (4) and to a feed process per se with a protection device (3) and with a protection process for use on a baling press (1) and with a bale-pressing process.

Figure 3:
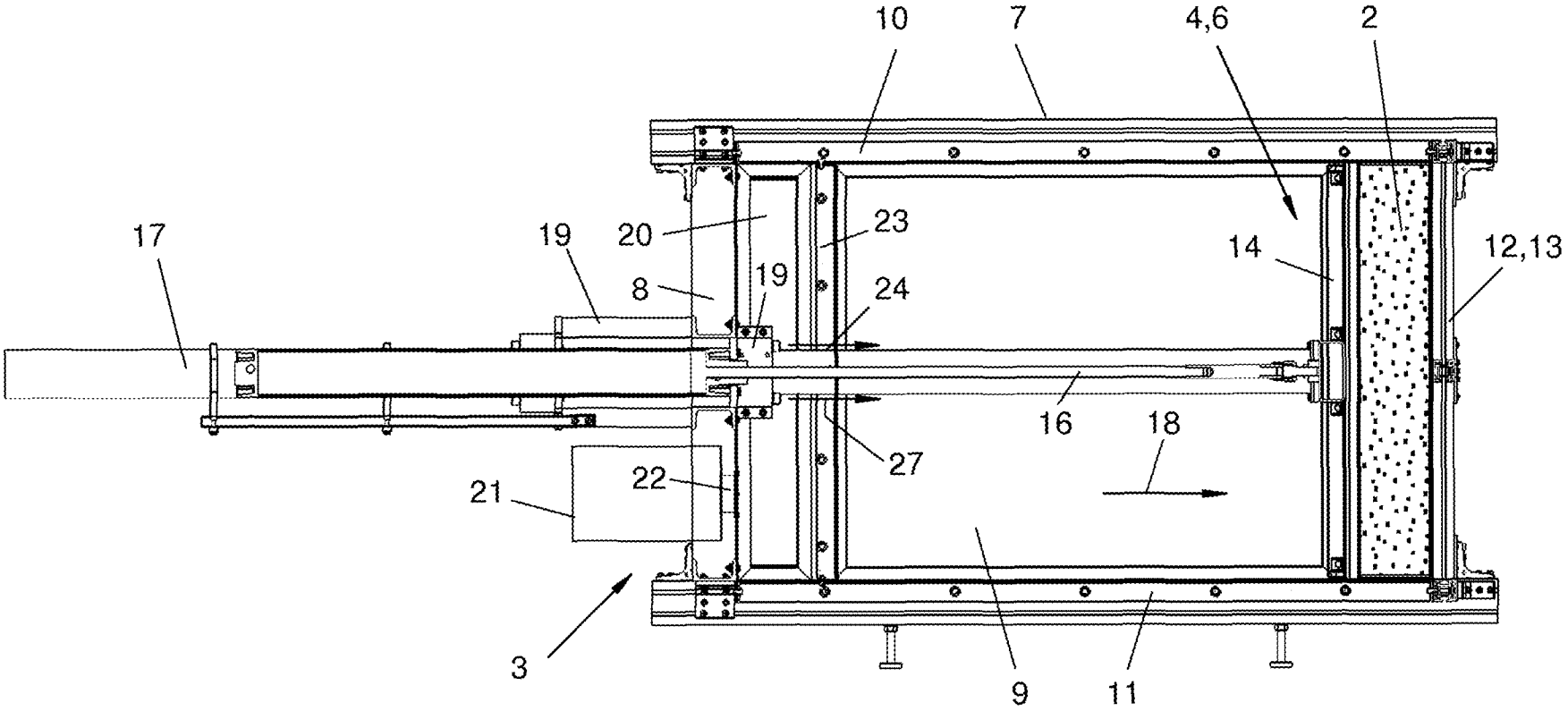
FIG. 3 is a central longitudinal sectional view through the device according to FIG. 2.
Figure 4:
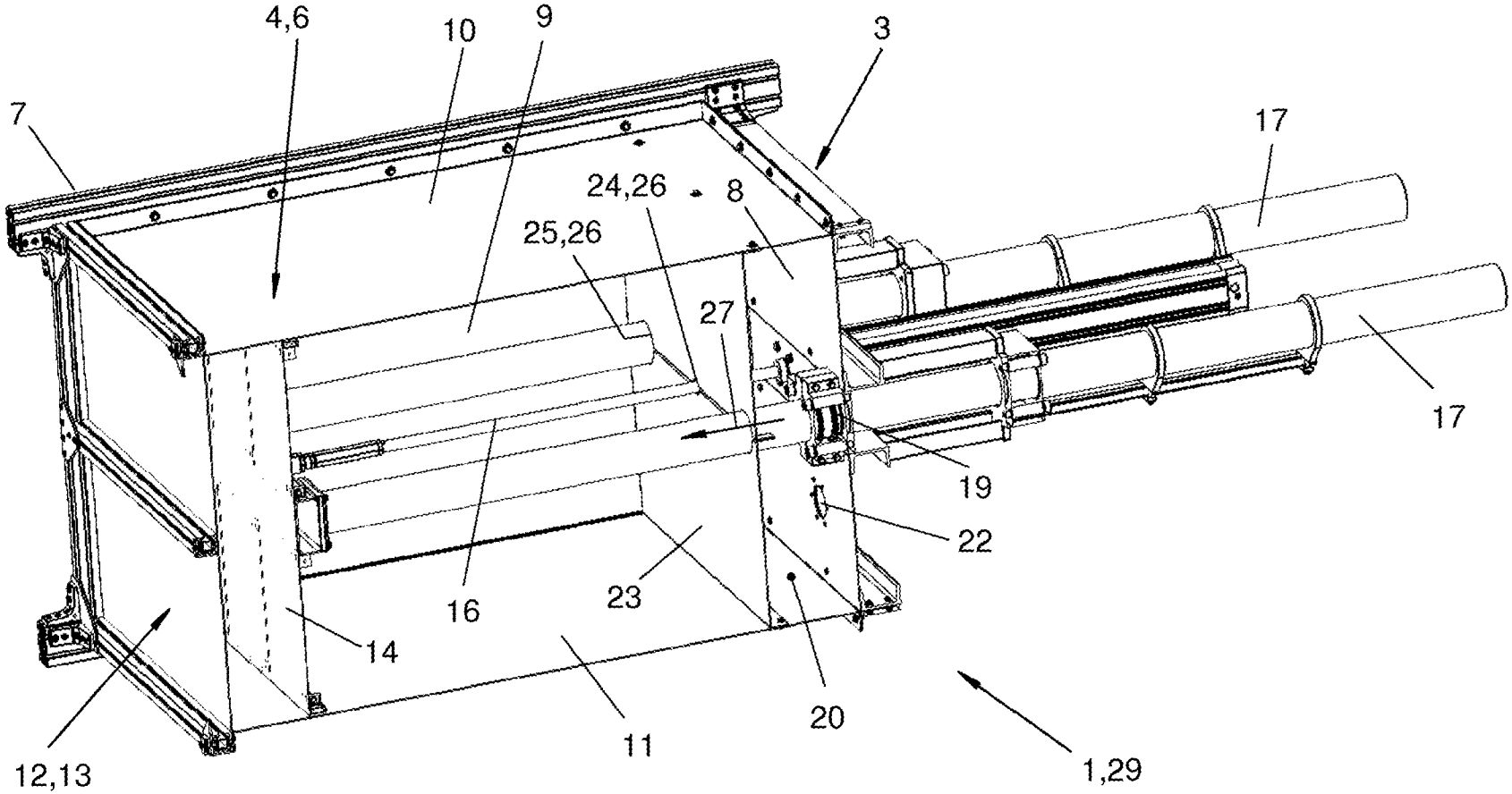
FIG. 4 is a perspective longitudinal sectional view offset from the center through the device according to FIG. 2.
Figure 6:
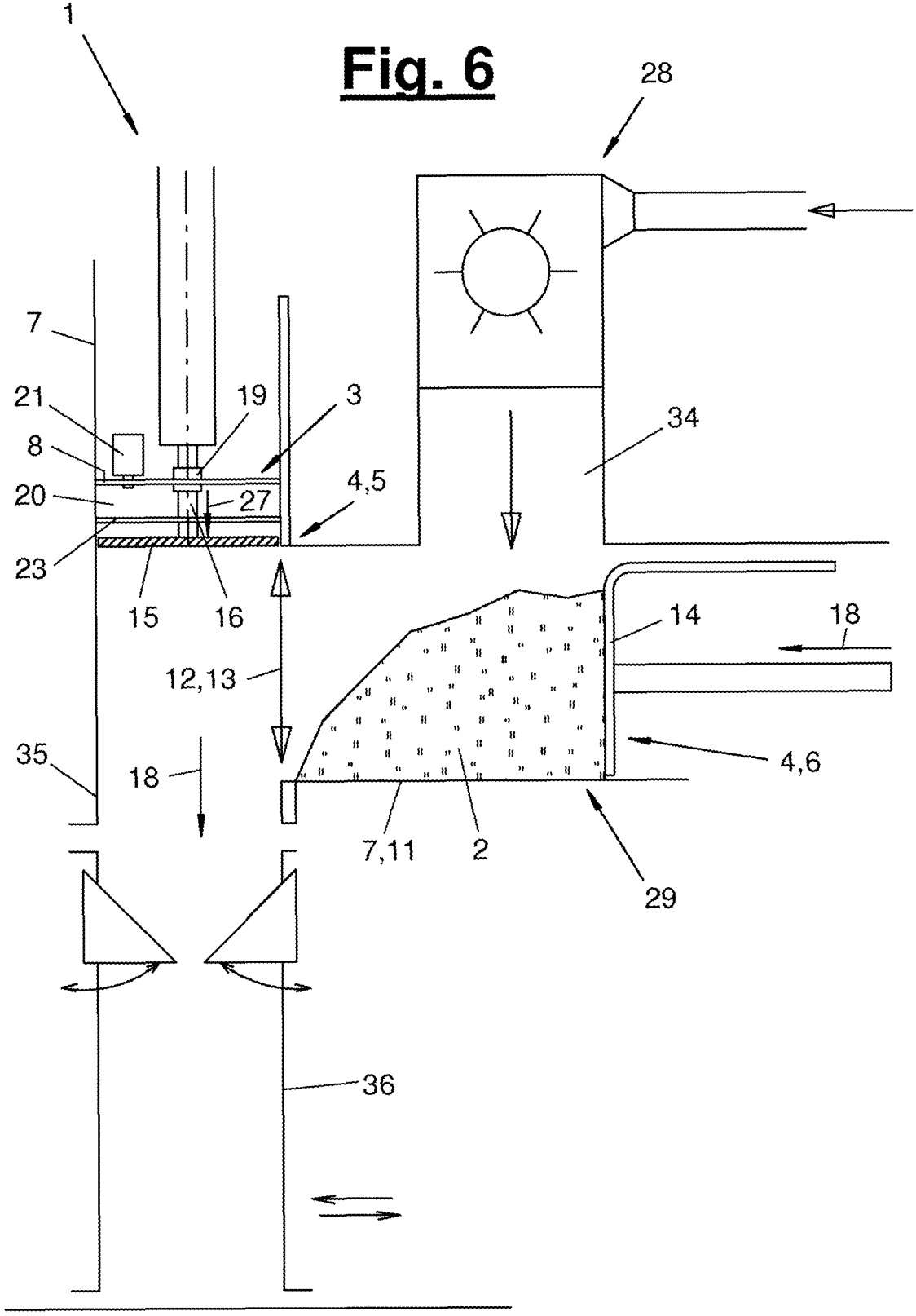
FIG. 6 is a baling press with a pressing device and with a protection device.

FIG. 1 shows a baling press (1) for producing highly compacted fiber bales from a fiber material (2) suggested in FIGS. 3 and 6. The fiber material (2) is preferably one consisting of short cut fibers, so-called staple fibers. The fiber material (2) preferably consists of synthetic fibers. As an alternative, the fibers may be natural fibers, mixed materials or the like. The fibers have a low weight and can be airborne or float in the air and can be carried by an air stream.

Figure 5:
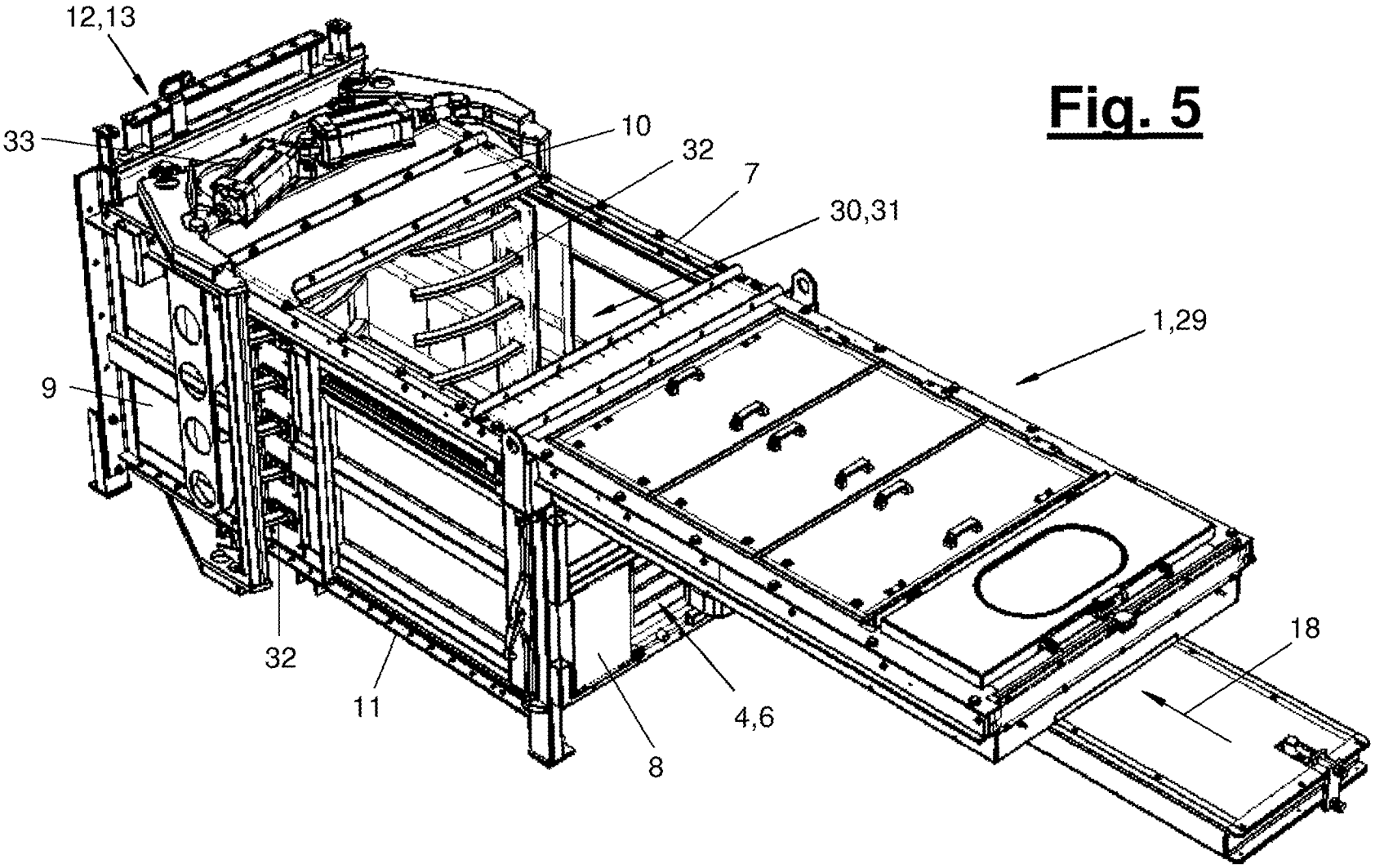
FIG. 5 is a variant of the filling device according to FIGS. 2 through 4 with a precompaction device and with a retaining device.

The baling press (1) has a fiber feed device (28), a filling device (29) and a pressing device (5). The filling device (29) may be equipped with a precompaction device (30) and with a retaining device (31). FIGS. 1 and 5 show such a configuration. The other figures show a filling device (29) without retaining device (31) and optionally without precompaction within the filling device (29). Further, a weighing device (not shown) for fiber material (2) may be present, e.g., at the filling device (29) and/or at another location.

The fiber material (2) is fed by a fiber processing unit into the fiber feed device (28). The fiber feed device (28) has, e.g., a condenser for separating the fibers from a transporting air stream and an adjacent feed shaft (34). The fiber material (2) enters the filling device (29) from the fiber feed device (28), especially the feed shaft (34). It is collected and optionally precompacted there and is subsequently transferred into the pressing device (5).

The pressing device (5) has a frame with a press shaft (35) and with a press drive as well as with press punches, between which the fiber material (2) is compacted and pressed in one stage or press stroke or in a plurality of stages or press strokes. This may be a combined prepressing and finishing pressing with the formation of a pressed bale. The pressed bale (not shown) may, in addition, be provided with a packaging or envelope and/or fixing device, especially a tightening strap (not shown). As an alternative, only prepressing may be carried out in the pressing device (5), in which case the finishing pressing is carried out in another location and at a later time.

The press shaft (35) and the press drive preferably have an upright, especially vertical orientation. The press shaft has, at a preferably lower end area, a mobile press box (36), in which the pressed bale is formed. The mobile press box (36) may be movable and able to be replaced together with the pressed fiber material. As an alternative, it may have a closable opening for the removal of the pressed material. The press box (36) can have retainers, which can be inserted into the shaft space, for the fiber material.

The press drive is configured, e.g., as a hydraulic press cylinder. In the embodiment shown, the press drive is arranged on the top side of the press shaft (35) and is connected to the upper press punch (15). The upper starting or inoperative position of the press punch (15) is located approximately at the level of or above the filling device (29). The lower press punch forms a counterpunch. It may be arranged stationarily. It may be located, in particular, at the bottom of the box. The kinematics and the arrangement of the press drive may alternatively be reversed. Both press punches may be driven in another variant.

The filling device (29) has a prone, especially horizontal or oblique orientation. It is attached laterally to the press shaft (35). An outlet opening (12) with a controllable closure (13) is arranged at the orifice location.

The baling press (1) has a feed device (4) for the loose fiber material (2) to be pressed, which feed device (4) may be present as a single device or as a plurality of devices. The feed device (4) has a movable and driven as well as possibly additionally guided feed element (14, 15). A protection device (3), which protects the drive area and possibly the guide area of the feed device (4), especially the bearing (19) thereof, with an opposing air stream (27) from airborne fibers, is associated with the feed device (4). During the feed motions and possibly during returning or reversing motions of the feed element (14, 15), the protection device (3) generates said opposing air stream (27), which blows away fibers, which are possibly coming from the feed element (14, 15) and are flying especially against the direction of feed (18), and prevents them from entering the drive area and possibly the guide area of the feed device (4). The opposing air stream (27) is directed here, e.g., in the direction of feed (18).

The baling press (1) may have one or more of these feed devices (4). A feed device (4) may be associated, e.g., with the filling device (29). The feed device (4) is formed by the filling pusher (6) in this case. FIGS. 1 through 5 show such a configuration.

As an alternative or in addition, a feed device (4) may be formed by the pressing device (5), especially by the pre-press. FIG. 6 shows such a configuration.

The feed device (4) has a housing each (7) in the different embodiment variants, in which housing the driven feed element (14, 15) is moved at least in the direction of feed (18) and possibly also reversibly in the opposite direction. In the configuration embodied as a filling pusher (6) of the filling device (29), the housing (7) is configured as a collection shaft and has the prone, especially horizontal or oblique direction shown. The housing (7) has, e.g., a cuboid shape and has housing walls (8, 9, 10, 11). The housing (7) is at the same time the housing of the filling device (29) and is attached laterally to the press shaft (35). At the orifice location, the housing (7) has a housing opening (12) or outlet opening, through which the collected and optionally pre-compacted fiber material (2) can be pushed over into the press shaft with the filling pusher (6) for the subsequent pressing. The outlet opening (12) is provided with a controllable closure (13), which is configured, e.g., as a movable partition with an adjusting drive. The closure (13) or the partition may be oriented, e.g., along the press shaft (35). It may now form a part of the press shaft wall.

The housing (7) otherwise has a preferably closed bottom (11) and bilateral tight or air-permeable, e.g., perforated, side walls (9) as well as a front wall located opposite the outlet opening (12) or rear wall (8). Further, a roof wall (10), through which the fiber material (2) can be fed from the feed shaft (34) adjoining here, is located on the top side. The roof wall (10) may have a corresponding inlet opening for this according to FIGS. 5 and 6. The roof wall (10) may alternatively be absent. The inlet opening on the top side of the housing can be closed as needed and in different manners. This may be brought about, e.g., by a controllable closure, e.g., a slide. As an alternative or in addition, the filling pusher (6) may have on the top side a corresponding, prone wall area, which closes the inlet opening in the front feed position. Such a configuration is shown in FIG. 6.

If the feed device (4) is configured as a pressing device (5), the housing (7) may have a tubular configuration according to FIG. 6 and form a part or an extension of the press shaft (35). In this case, the housing (7) has side walls (9) and a front wall or rear wall (8) and is downwardly open in the vertical orientation of the press shaft.

The feed element (14, 15) is always arranged movably in the housing (7) in the different variants of the feed device (4). It preferably performs a reversing linear motion. The feed element (14, 15) preferably has a plate-like shape and is oriented essentially at right angles to the direction of feed (18) in the different embodiments. It tightly adjoins with its side edges the lateral as well as lower and possibly upper housing walls (9, 10, 11).

The feed element (14, 15) may have a wall, which is closed in the direction of feed (18). As an alternative, it may be configured as a perforated plate and have air-permeable passage openings in the plate surface. These allow a pressure equalization between the feeding front side and the rear side of the feed element (14, 15).

In the configuration as a filling pusher (6), the feed element (14) is configured as a slider wall and is moved linearly in the horizontal or oblique direction. In the other configuration as a pressing device (5), the feed element (15) is configured as an upper press punch and performs a vertical or essentially vertical feed motion. The return motions are always directed opposite the direction of feed (18).

The drive of a feed element (14, 15) may have any desired and suitable configuration. In the exemplary embodiments shown, it is a cylinder, whose extendable drive element (16), especially piston rod, is connected to the feed element (14, 15), especially on the rear side of the feed element (14, 15).

The feed element (14, 15) is provided with a separate guide, e.g., a rod guide, in the embodiments shown. It has one or more guide elements (17), which are likewise connected to the feed element (14, 15) on the rear side and which are configured, e.g., as extendable or telescopic guide rods.

The drive elements (16) and the guide elements (17) may have a bearing (19) each, which makes supporting and guiding at the housing (7) possible during their feed motion and return motion. The bearing (19) may be configured, e.g., as a slide bearing. The drive elements (16) and possibly the guide elements (17) protrude into the housing (7) from the outside and preferably through the rear wall (8). Other drive and guide parts, especially the cylinder, may be arranged and supported outside the housing (7). One or more bearings (19) may be arranged in or at the rear wall (8). They may be accessible from the interior of the housing.

The protection device (3) has an overpressure chamber (20) with a chamber wall (23) pointing towards the feed element (14, 15). The overpressure chamber (20) is arranged behind the feed element (14, 15) in the direction of feed (18) in the exemplary embodiments shown. The overpressure chamber (20) is arranged in the housing (7) in the embodiments shown. It is located here in front of the housing rear wall (8). The overpressure chamber (20) is used especially to shield the one or more bearings (19) against the entry of fibers.

The chamber wall (23) is arranged in the housing (7) cross-wise and at a spaced location in front of the housing rear wall (8). A passage opening (24) for a drive element (16), which passage opening (26) is oversized relative to the drive element (16) and forms as a result a free space (26), e.g., an annular gap, on the circumference of the drive element (16), is arranged in the chamber wall (23). In case of a separate guide, one or more other passage openings (25) may be arranged in the chamber wall (23) for a guide element (17). These may likewise be oversized to provide a free space (26), especially an annular gap, on the circumference of the guide element (17). The drive element or the drive elements (16) and optionally the guide element or the guide elements (17) can move through their passage openings (24, 25) back and forth during the feed and return motion of the feed element (14, 15).

The overpressure chamber (20) has an associated overpressure generator (21), which generates an atmospheric overpressure in the overpressure chamber relative to the rest of the interior of the housing. The overpressure is preferably present in all motion positions of the feed element (14, 15). The overpressure generates an opposing air stream (27) suggested in FIG. 3 through the free space or free spaces (26), especially annular spaces. The opposing air stream (27) is directed essentially in the direction of feed (18).

It blows away fibers possibly present behind the feed element (14, 15) in the direction of feed (18). As a result, it prevents fibers from entering the overpressure chamber (20) or it makes such entry significantly difficult, on the one hand. On the other hand, the opposing air stream (27) blows off possibly adhering fibers on a returning drive element (16) and possibly on a guide element (17) during a reversing motion of the feed element (14, 15).

The overpressure generator (21) may be arranged inside or outside the overpressure chamber (20). It may have any desired and suitable configuration, e.g., a configuration as a blower. Such a blower (21) is preferably configured as a fan, which delivers high volume flows at a slight increase in pressure. The pressure ratio between the overpressure chamber (20) and the rest of the interior of the housing may be, e.g., 1.1 to 2. The blower (21), especially the fan, may be arranged, e.g., on the outer side of the housing (7) and connected to the overpressure chamber (20) via a pipe branch-like port (22). The overpressure generator (21) may be able to be controlled or regulated. It may operate constantly or as a function of motions and positions of the feed element (14, 15).

The overpressure chamber (20) may be defined by said chamber wall (23) on the front side and by the housing rear wall (8) on the rear side as well as by the housing walls (9, 10, 11) laterally. The overpressure chamber (20) may be closed or sealed air-tightly aside from the free space (26) or free spaces and a possible port (22). The chamber wall (23) is fastened correspondingly tightly in the housing (7).

The protection device (3) may be used in one or more of the aforementioned feed devices (4) and may be used to protect it/them from contamination by fibers. The protection device (3) may be associated, according to FIG. 6, with a filling pusher (6) according to FIGS. 3 through 5 and/or with a pressing device (5), especially a prepress.

In case of association with a pressing device (5), a transversely arranged chamber wall (23) and optionally a rear-side or upper housing wall (8) are inserted in the housing (7) or in the press shaft (35) to form the overpressure chamber (20). The housing area adjoining in the direction of feed (18) may be open laterally in the area of the outlet opening (12) and may optionally be able to be closed with the closure (13). FIG. 6 shows a variant, in which the protection device (3) is only associated with the pressing device (5) and is missing at the filling device (29) and the filling pusher (6) thereof. As an alternative, a protection device (3) according to FIGS. 2 through 5 may likewise be arranged here as well.

FIGS. 1 and 5 show an embodiment variant of the filling device (29), which additionally has a precompaction device (30). The precompaction device (30) makes possible the collection and precompaction of a plurality of batches of fiber material in the housing (7) or in the collection shaft with the housing opening (12) closed and with the closure (13) locked. The filling pusher (6) and the closure (13) as well as optionally the fiber feed device (28) or a controllable closure at the inlet opening are controlled such that the filling pusher (6) feeds a plurality of batches of fiber material in the direction of the outlet opening (12) one after another in a plurality of feed and return motions and compacts them against the closed closure (13) in the precompaction area located there.

This may take place during a press cycle of the pressing device (5), and the filling pusher (6) subsequently pushes the collected and compacted fiber material (2) over into the press shaft (35) after the opening of the closure. This precompaction in the filling device (29) shortens the process time for producing the pressed bale and relieves the load on the pressing device (5).

The retaining device (31) secures the one or more precompacted batches of fiber material during the return stroke of the filling pusher (6) and prevents these batches from flowing back into a collection area of the housing (7) under the inlet opening.

The retaining device (31) has one or more retainers (32) and a controllable drive (33). The retainers (32) are configured, e.g., as bent retaining arms, which can penetrate into the interior of the housing through inlet openings in the side walls (9) and move back during a rotary motion about a vertical axis. They pivot into the interior of the housing as soon as the filling pusher (6) and the pusher wall (14) thereof have moved back far enough after the prepressing. FIG. 5 shows this configuration. A modified configuration of the drive and of the guide device of the filling pusher (6) is shown here as well. In addition, the inlet opening in the roof wall (10) is seen. The closure of this opening by an upper transverse wall at the filling pusher (6) or by a separate closure or slide at the fiber feed device (28) are not shown.

The embodiment shown in FIG. 5 may be used with or without protection device (3). Further, the pusher wall (14) may have a non-air-permeable configuration or may be configured as a perforated plate. In an independent embodiment of the present invention, a baling press with the filling device (29) shown in FIG. 5 along with the precompaction device (30) and with the retaining device (31) in conjunction with a perforated plate is possible, and this baling press (1) may be configured with or without protection device (3).

Various variants of the embodiments shown and described are possible. In particular, the features of the exemplary embodiments and of the variants mentioned may be combined and possibly also be replaced with one another as desired.

In a variation of the embodiments described, a feed device (4) may have a rotating or pivotable feed element. A protection device (3) with an overpressure chamber (20) may be arranged here between the rotary or pivoting drive and the feed element. An additional guide device may be eliminated here. The chamber wall (23) may have a single passage opening (24) with said free space (26) for a rotating drive element (16) or an axis of rotation.

A feed device (4) with a protection device (3) may also be arranged in another location of a baling press (1), e.g., in the area of the fiber feed device (28), especially at a condenser located there. A protection device (3) may be arranged at any desired number and type of feed devices (4).

Further, various variants of the baling press (1) are possible. The pressing device (5) and the press shaft (35) may have a different, e.g., horizontal orientation. The filling device (29) may be arranged and configured differently. It may have, e.g., oblique filling shafts with pivoting closures, slides or the like. These may likewise form feed devices of the above-mentioned type, and the fibers are conveyed by gravity, compressed air or in another manner, and the feed element is of a passive nature and is formed by a controllable and optionally driven closing device, e.g., a turn-lock fastener, slide or the like. A protection device (3) of the above-described type may be used with a corresponding adaptation in such an embodiment as well.

While specific embodiments of the invention have been shown and described in detail to illustrate the application of the principles of the invention, it will be understood that the invention may be embodied otherwise without departing from such principles.

The invention claimed is:

1. A feed device for a baling press and for a loose fiber material to be pressed, the feed device comprising:

a housing having a housing opening at an orifice location;

a movable and driven feed element mounted for reversible linear movement in the housing, the feed element being configured as a perforated plate with passage openings permeable to air in a plate surface of the feed element;

a feed drive element connected to the feed element and configured to drive the feed element with the reversible linear movement in the housing including movement in a direction of feed to advance loose fiber material to the housing opening, wherein the perforated plate is configured to bring about an exchange of air and a pressure equalization in the areas located in front of the perforated plate and a drive area located behind the perforated plate, during the reversible linear movement;

a protection device positioned in the drive area and associated with the feed element, the protection device configured to protect the drive area from airborne fibers by generating an opposing air stream directed along a longitudinal axis of the feed drive element and to the feed element, wherein the opposing air stream is directed in the direction of feed to advance loose fiber material to the housing opening, and wherein the opposing air stream generated by an overpressure generator having a port facing toward the feed element.

2. The feed device in accordance with claim 1, wherein the feed device is configured as a prepress, and/or as a filling pusher of a baling press.

3. The feed device in accordance with claim 1, wherein the feed drive element comprises a piston rod connected to the feed element.

4. The feed device in accordance with claim 1, further comprising a guide element configured to guide the feed element.

5. The feed device in accordance with claim 1, wherein the protection device comprises an overpressure chamber with a chamber wall pointing towards the feed element.

6. The feed device in accordance with claim 5, wherein: the overpressure chamber is arranged in the housing.

7. The feed device in accordance with claim 5, wherein the overpressure generator, comprising a blower, is associated with the overpressure chamber.

8. The feed device in accordance with claim 5, wherein:

a passage opening is arranged in the chamber wall and the feed drive element passes through the passage opening; and the passage opening is oversized to provide a free space for passage of the opposing air stream from the overpressure chamber into the interior of the housing and to the feed element.

9. The feed device in accordance with claim 4, wherein:

the protection device comprises an overpressure chamber with a chamber wall pointing towards the feed element;

a passage opening is arranged in the chamber wall and the guide element of the feed element passes through the passage opening; and the passage opening is oversized to provide a free space, for the passage of the opposing air stream from the overpressure chamber into the interior of the housing and to the feed element.

10. The feed device in accordance with claim 4, wherein the guide element is configured as an extendable guide rod.

11. A baling press comprising:

a housing having a housing opening at an orifice location;

a feed device for loose fiber material to be pressed, wherein the feed device comprises: a movable and driven feed element mounted to reversibly and linearly move in the housing, the feed element being configured as a perforated plate with passage openings permeable to air in the plate surface of the feed element;

a feed drive element connected to the feed element and configured to drive the feed element with reversible linear movement in the housing, the reversible linear movement including movement in a direction of feed to advance loose fiber material to the housing opening, wherein the perforated plate is configured to bring about an exchange of air and a pressure equalization in the areas located in front of the perforated plate and a drive area located behind the perforated plate during the reversible linear movement; and a protection device positioned in the drive area and associated with the feed element, the protection device configured to protect the drive area from airborne fibers by generating an opposing air stream directed along a longitudinal axis of the feed drive element and to the feed element, wherein the opposing air stream is directed in the direction of feed to advance loose fiber material to the housing opening, and wherein the opposing air stream generated by an overpressure generator having a port facing toward the feed element.

12. The baling press in accordance with claim 11, further comprising a fiber feed device and a filling device with a housing configured as a collection shaft and with a filling pusher, wherein the housing has an outlet opening with a controllable closure.

13. The baling press in accordance with claim 12, wherein the filling device comprises a precompaction device with a retaining device for collecting and precompacting fiber material batch by batch in the housing.

* * * * *